US006864759B2

(12) United States Patent
Lonsdale et al.

(10) Patent No.: US 6,864,759 B2
(45) Date of Patent: Mar. 8, 2005

(54) ROTARY SIGNAL COUPLER

(75) Inventors: Anthony Lonsdale, Banbury (GB); Bryan Lonsdale, Banbury (GB)

(73) Assignee: Transense Technologies PLC (GB)

( * ) Notice: Subject to any disclaimer, the term of this patent is extended or adjusted under 35 U.S.C. 154(b) by 83 days.

(21) Appl. No.: 10/362,726

(22) PCT Filed: Sep. 3, 2001

(86) PCT No.: PCT/GB01/03931

§ 371 (c)(1),
(2), (4) Date: Feb. 27, 2003

(87) PCT Pub. No.: WO02/19457

PCT Pub. Date: Mar. 7, 2002

(65) Prior Publication Data

US 2003/0174062 A1 Sep. 18, 2003

(51) Int. Cl.[7] ..... H01P 5/18; H01P 1/06

(52) U.S. Cl. ..... 333/116; 333/174; 333/175; 333/261

(58) Field of Search ..... 333/109, 116, 333/174, 175, 261; 340/665, 672, 682

(56) References Cited

U.S. PATENT DOCUMENTS 4,089,049 A 5/1978 Suzuki et al.
4,238,733 A * 12/1980 Freeman ..... 324/772
4,242,666 A 12/1980 Reschovsky et al.
6,018,279 A * 1/2000 Arthur ..... 333/116
6,478,584 B2 * 11/2002 Vile et al. ..... 439/13

FOREIGN PATENT DOCUMENTS

GB 2 328 068 2/1999
GB 2 350 938 12/2000

* cited by examiner

*Primary Examiner*—Dinh T. Le
(74) *Attorney, Agent, or Firm*—Keusey, Tutunjian & Bitetto, P.C.

(57) ABSTRACT

A rotary signal coupler for providing signal coupling to a Surface Acoustic Wave (SAW) device (4) mounted on a shaft (5) includes a first electrically conducting loop (21) mounted on a disc (23) and connected to the SAW device (4), and a second electrically conductive loop (22) mounted on a disc (24) and connected to external electronic circuitry. The disc (23) is fixed relative to the shaft (5) and the disc (24) is fixed relative to the structure in which the shaft (5) rotates so that the loops (21, 22) are inductively coupled. A grounded screen (27), which preferably takes the form of a plurality of radially extending fingers is located on the disc (23) and positioned between the loops (21, 22) to eliminate capacitive coupling therebetween.

12 Claims, 8 Drawing Sheets

Magnetic Rotary Couple + SAW (S11) Typical Response

Magnetic RF Couple Response

ROTARY SIGNAL COUPLER

FIELD OF THE INVENTION

This invention relates to a rotary signal coupler, that is to say, a device for providing signal coupling between two components which are rotatable relative to each other.

DESCRIPTION OF RELATED ART

Published International patent application WO 91/13832 describes a strain measuring method and apparatus particularly suitable for measuring torque applied to a shaft. The described method and apparatus make use of a surface acoustic wave (SAW) device mounted on the shaft. Use of such a device requires the passage of high frequency, typically radio frequency (RF), signals between the device itself and an associated drive/measuring circuitry. If the shaft to which the SAW device is attached rotates only through a small angular range, the SAW device may be hard wired to its associated drive/measuring circuitry. There are, however, many applications of the torque measuring technique described in WO 91/13832 which are not susceptible to hard wiring between the SAW device and its associated drive/measuring circuitry, and such applications require the use of a rotary signal coupling device in order to effect the required connection.

Our prior United Kingdom patent publication GB-A-2328086 discloses a rotary signal coupling device which may be used to provide the required coupling to a SAW device at RF frequencies. The described device includes a pair of transmission lines, each comprising an electrically conductive track and an associated ground plane. The tracks are each substantially circular, but each defines a gap so as to form a transmission line with its associated ground plane. The tracks are arranged coaxially about the shaft carrying the SAW device, one track and its associated ground plane being secured to the shaft while the other track and its associated ground plane is secured to a fixed structure through which the shaft passes. The tracks are separated by a thin sheet of dielectric material or by a small air gap. One end of the track secured to the fixed structure is connected to the drive/measuring circuitry and one end of the track which is secured to the shaft is connected to the SAW device. The ends of the tracks opposite to their respective connections to the drive circuitry and the SAW device may be earthed or may be left open circuit.

In the arrangement of GB-A-2328086 the degree of coupling between the respective transmission lines is determined, for any particular spacing between the respective tracks, by the length of the tracks. For a high degree of coupling, the length of the tracks must be optimized to the frequency of the signal to be coupled. Also, in order to form transmission lines each track must have associated therewith a respective ground plane. These characteristics impose design limitations on the coupling device and, in particular, restricts the degree to which the coupling device may be reduced in size and yet still achieve an acceptable degree of coupling.

SUMMARY OF THE INVENTION

We have now devised a coupling device which can provide the necessary signal coupling to the SAW device, but in which the degree of coupling provided by the coupling device is determined by the inductance of loops provided within the coupling device, rather than by the length of the transmission lines as in the case of GB-A-2328086. One of the loops may, in fact, be provided by an annular track of a transmission line, this track having associated with it a ground plane. However, even if one of the loops is provided by a transmission line, the other loop can be a simple turn of conducting material, and need not have a ground plane associated therewith.

According to one aspect of the present invention a rotary signal coupler for providing signal coupling to a SAW device mounted on a shaft rotatable relative to a fixed structure comprises: a first electrically conductive loop, connected to the SAW device, and fixed relative to the shaft; a second electrically conductive loop, connectable to electronic circuitry, and fixed relative to the fixed structure, the first and second loops being arranged in juxtaposition to provide inductive coupling therebetween and being positioned to remain at a substantially constant mutual spacing as the shaft rotates relative to the fixed structure; and electrically conductive means located between the first loop and the second loop, the electrically conductive means being grounded to eliminate or substantially eliminate electric coupling between the loops.

A preferred embodiment of the invention has been found to provide acceptable coupling (−4 dB or better) and a substantially flat response over a frequency range of 100–170 MHz.

In the preferred embodiments of the invention each loop is provided on a disc of material, one of the discs being fast with the shaft and the other of the discs being fast with the structure in which the shaft rotates. The discs are arranged face to face with a small air gap or a wafer of insulating material therebetween. One loop is provided on that face of one disc which is adjacent to the other disc, while the other loop is provided on that face of the other disc which is remote from the one disc. The electrically conductive means is provided on that face of the other disc which is adjacent to the one disc. Such an arrangement results in a structure which can readily be manufactured and implemented on a mass production basis.

BRIEF DESCRIPTION OF THE DRAWINGS

The above and further features and advantages of the present invention will become clear from the following description of preferred embodiments thereof given by way of example only, reference being had to the accompanying drawings wherein.

DETAILED DESCRIPTION OF PREFERRED EMBODIMENTS

Figure 1:
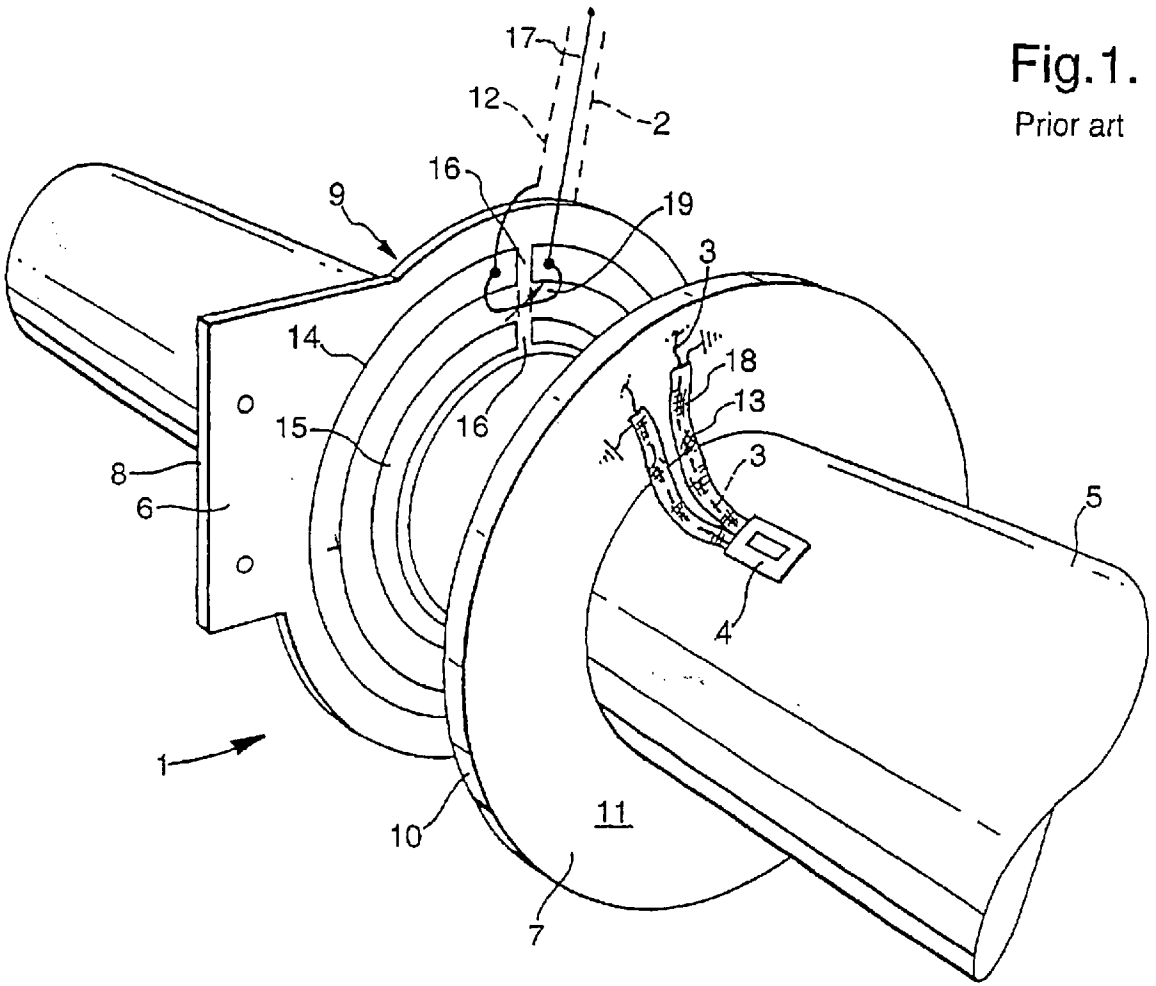
Fig.1. Prior art
FIG. 1 illustrates schematically a prior art rotary signal coupler disclosed in GB-A-2 329 086.

Referring firstly to FIG. 1, the illustrated prior art coupler 1 is shown schematically for providing signal coupling between a coax cable 2 and a coax cable 3. In the illustrated coupler, the coax cable 2 is connected to a drive/measuring circuit (not shown) and the coax cable 3 is connected to a SAW device 4 mounted on a shaft 5. The coupler accordingly facilitates signal connection between the drive/measuring circuit and the SAW device for the purpose of measuring torque applied to the shaft 5.

The coupler 1 comprises a first part 6 which is secured to a fixed support by appropriate means and a second part 7 which is secured to the shaft 5. The parts 6,7 face each other and, in practice, are separated either by a small air gap or by a thin sheet of insulating material. The separation of the parts 6,7 has been exaggerated in the drawing so that the structure of the part 6 may be seen clearly. In practice, the parts 6,7 are likely to be separated by a small amount, typically 1 mm.

The first part 6 comprises a sheet 8 of insulating material which supports, on the side thereof remote from the second part 7, a metal screen 9. Similarly, the second part 7 comprises a sheet 10 of insulating material which supports, on the side thereof remote from the first part 6, a metal screen 11. The screen 9 is grounded, e.g. by way of connection to a screen 12 of the coax cable 2. The screen 11 is electrically connected to the shaft 5, e.g. by way of a screen 13 of the coax cable 3. The shaft 5 will in general be grounded and accordingly the screens 8 and 11 are electrically connected.

The first part 6 has formed thereon two annular tracks 14,15. In a basic arrangement, only one track will be present, but in more complicated arrangements, several additional tracks may be present. Additional tracks may be used for signal coupling to additional devices. For example, if two separate SAW devices are secured to the shaft, two separate tracks would be used to provide coupling to them.

The tracks 14,15 may be of any suitable material, for example copper foil.

The tracks 14,15 are in the form of complete circles except for a gap 16 which forms an electrical discontinuity in each track. One end of the track 14 is connected to the core 17 of the coax cable 2. If an additional track, for example the track 15, is used, it will have associated therewith appropriate cable connections. For the purposes of illustration, only the outer track 14 is shown connected to a cable.

The face of the second part 7 adjacent the first part 6 has formed thereon tracks which mirror those of the part 6, as described above. One end of the outer track of the part 7 is connected to the core 18 of the coax cable 3, and the opposite end of that track is connected to the screen 13 of the coax cable 3 and to the screen 11 of the part 7.

The respective tracks and their associated ground planes form transmission lines. The degree of coupling between the respective transmission lines is determined by the length of the respective transmission lines which, for circular transmission lines, is proportional to the radius of the tracks. Also, each track must have associated therewith a ground plane to form the required transmission line. These factors impose significant limitations on the design of the coupling.

Referring now to FIGS. 2–11, various embodiments of the invention are illustrated.

In the first embodiment, the improved coupler 20 comprises a first electrically conductive loop 21 connected to a SAW device 4 and a second electrical loop 22 connectable by appropriate cable to drive/measuring circuitry (not shown) for providing an excitation signal to the SAW device 4 and for analyzing the characteristic response of the SAW device 4. Tuning capacitors 19 are connected across both loops to facilitate tuning the characteristics of the loops.

The loops 21, 22 are mounted on respective discs 23,24, the disc 23 being fast with the shaft 5 and the disc 24 being fast with a fixed structure in which the shaft 5 is mounted. The discs are, in practice, mounted close to each other and may be separated by a small air gap or by a wafer of insulating material. The separation of the discs has been exaggerated in the drawings in the interests of clarity.

Figure 5:
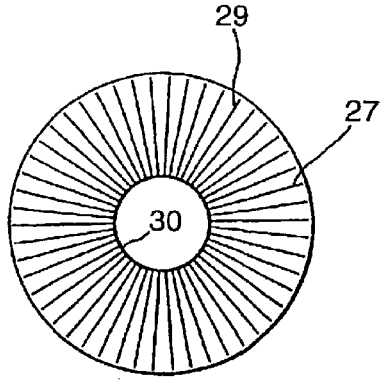
FIG. 5 illustrates schematically the radial screen of the first embodiment.

The loop 21 is mounted on the face 25 of the disc 23 which is remote from the disc 24. The loop 22 is mounted on the face 26 of the disc 24 which is adjacent to the disc 23. An electrical screen 27 is provided between the loops 21,22. The screen 27 is conveniently provided by fixing suitable screening material to the face 28 of the disc 23 which is nearest the disc 24. The screen 27 may, as illustrated in FIG. 5, conveniently take the form of a multiplicity of radial fingers 29 of metal, the fingers being connected together by a common central ring 30 which, in use, is electrically connected to the shaft 5. The shaft 5 is itself grounded and accordingly the screen 27 forms a grounded screen between the loops 21,22 and hence reduces or substantially eliminates capacitive coupling between the loops.

Figure 4:
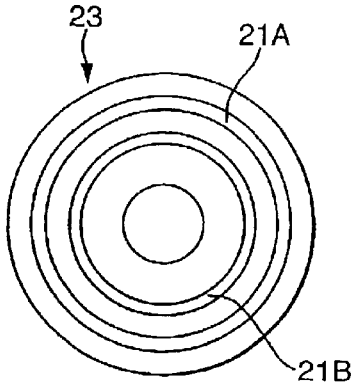
FIG. 4 illustrates schematically concentric tracks provided on the stator/rotor of the first embodiment.

If more than one SAW device is mounted on the shaft 5 the discs 23,24 may be provided with further loops each of which provides coupling to a respective SAW device. The loops will be arranged concentrically. FIG. 4 illustrates a disc 23 having two loops 21A and 21B suitable for providing connections to two SAW devices.

Figure 2:
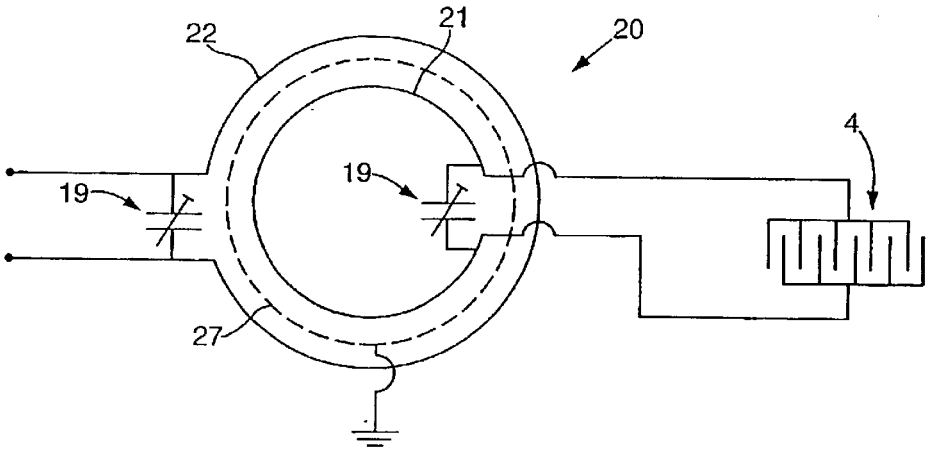
FIG. 2 illustrates schematically the electric circuitry of a first embodiment of the present invention.
Figure 3:
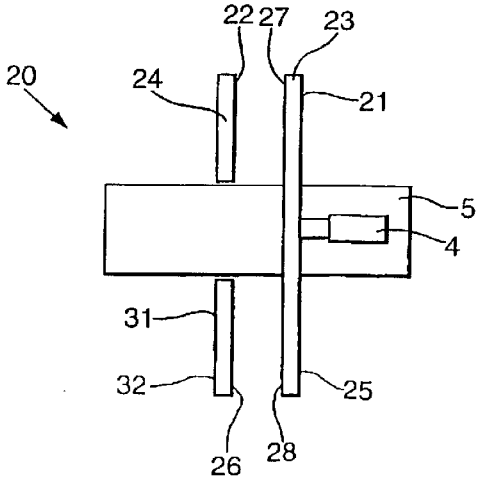
FIG. 3 illustrates schematically the mechanical arrangement of the first embodiment.

Whilst the loops 21,22 are shown schematically in FIG. 2 as being of different diameters with the loop 21 smaller than the loop 22, it will be appreciated that in practice the loops may be as illustrated, or may be of equal diameter, or the loop 21 may be larger than the loop 22.

It will be appreciated that because, in the case of the embodiment of the invention described above, the coupling between the SAW device and the driver/measuring circuitry is provided by the inductive coupling of two loops, no "ground plane" is required as was required in the prior art GB-A-2328086. This absence of ground plane may substantially simplify design of couplings. It is to be noted, however, that the face 31 of the disc 24 which is remote from the disc 23 may, if desired, be provided with a grounded screen 32. Such a grounded screen 32 may be used as a ground plane which, in association with the loop 22, forms a transmission line. It will be noted that even if the loop 22 and ground plane form a transmission line on the disc 24, the arrangement is still different from the prior art as represented by GB-A-2328086 since no ground plane is associated with the loop 21 and the screen 27 is interposed between the loops 21 and 22.

Figure 6:
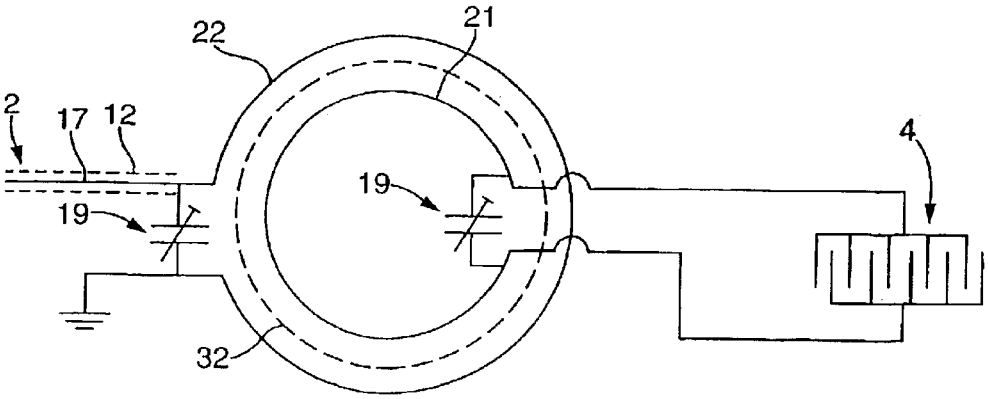
FIG. 6 illustrates schematically the electric circuitry of a second embodiment of the present invention.

In the second embodiment of the invention illustrated in FIG. 6 one end of the loop 22 is grounded and that end is connected to a grounded screen 32. Accordingly, in this arrangement the loop 22 and ground plane 32 form a transmission line having an unbalanced input characteristic.

Figure 7:
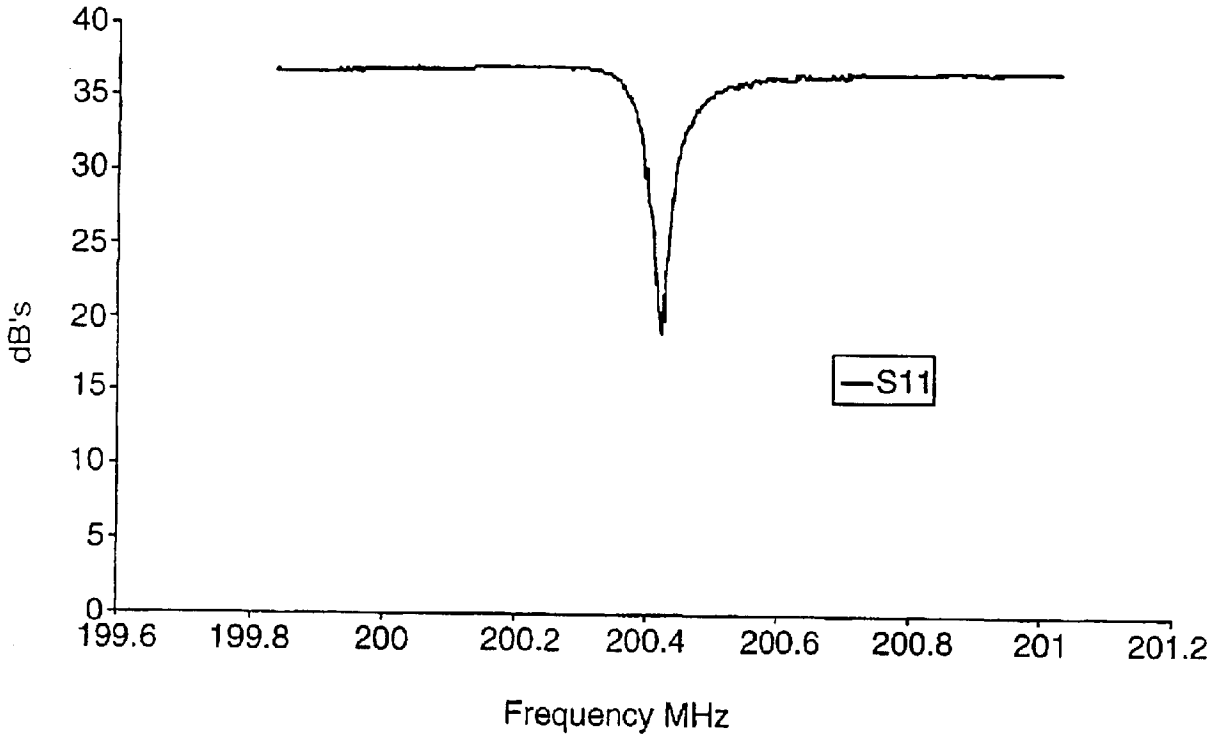
FIG. 7 illustrates schematically the overall response of a coupling system comprising either of the first or second embodiments connected to a SAW device.
Figure 8:
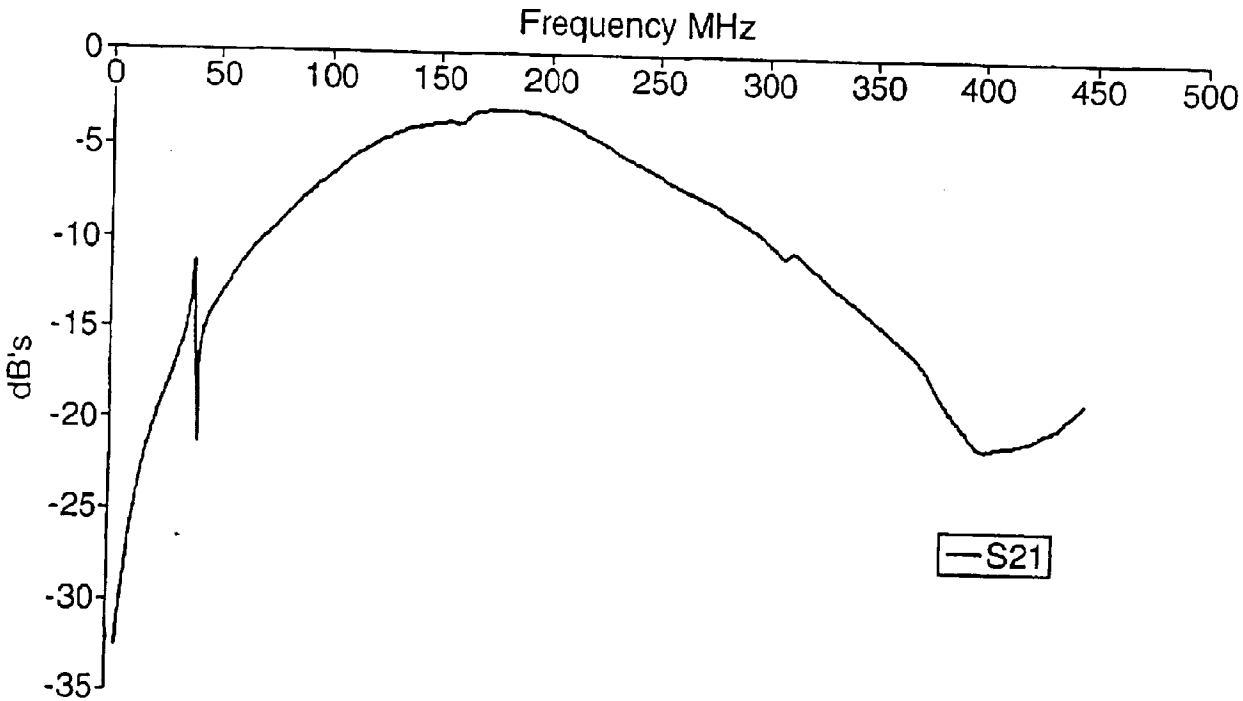
FIG. 8 illustrates schematically the coupling response of either of the first or second embodiments.
Figure 9:
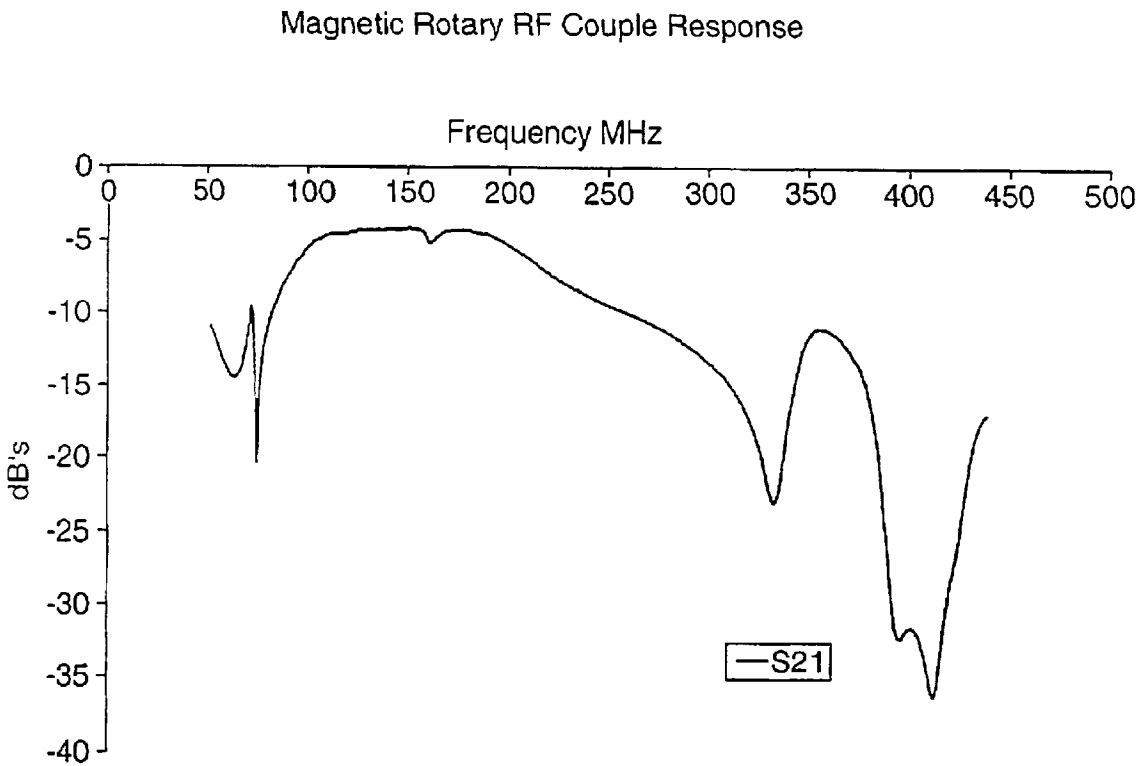
FIG. 9 illustrates schematically the coupling response of a third embodiment of the present invention.

The performance of the first and second embodiments is illustrated in FIGS. 7 and 8. The overall response of a system comprising either of the first or second embodiments 20, 24 together with a SAW device is graphically illustrated in FIG. 7 whereas the coupler response of the embodiments per se is shown in FIG. 8. By way of comparison, the coupler response of a third embodiment is shown in FIG. 9. In the third embodiment (not shown), the radial electric shield 27 is provided on the disc 24 rather than on the disc 23. The rotor disc 23 provides support on its face 28, for concentric circular loops and on its face 25, for a metal screen ground plane. The face 26 of the disc 24 is used to support a radial electric shield 27. The opposite face (31) of the disc 24, is used for mounting the fixed loops. The radial electric shield 27 is thereby located between the concentric loops of the disc 23 and the disc 24. The ground plane provided on the stator part 6 of the prior art coupler 1 is not present in the third embodiment. The loops of the third embodiment may be connected so as to provide an input and output which are each either balanced or unbalanced. The radial electric shield 27 of the third embodiment may be electrically connected to the loops provided on the disc 24.

In certain circumstances, the use of the third embodiment is inappropriate. For example, where it is necessary to locate the disc 24 in close proximity to a relatively large mass of metal, the effectiveness of the loops provided on the disc 24 is reduced. In such a case, it is preferable to maximize the spacing of the loops from the mass of metal. In this regard, displacement of the loops from the face of the disc 24 adjacent the mass of metal to the opposite face of the disc 24 can be advantageous. As described above, such arrangement is provided by the first and second embodiments of the present invention.

Figure 10:
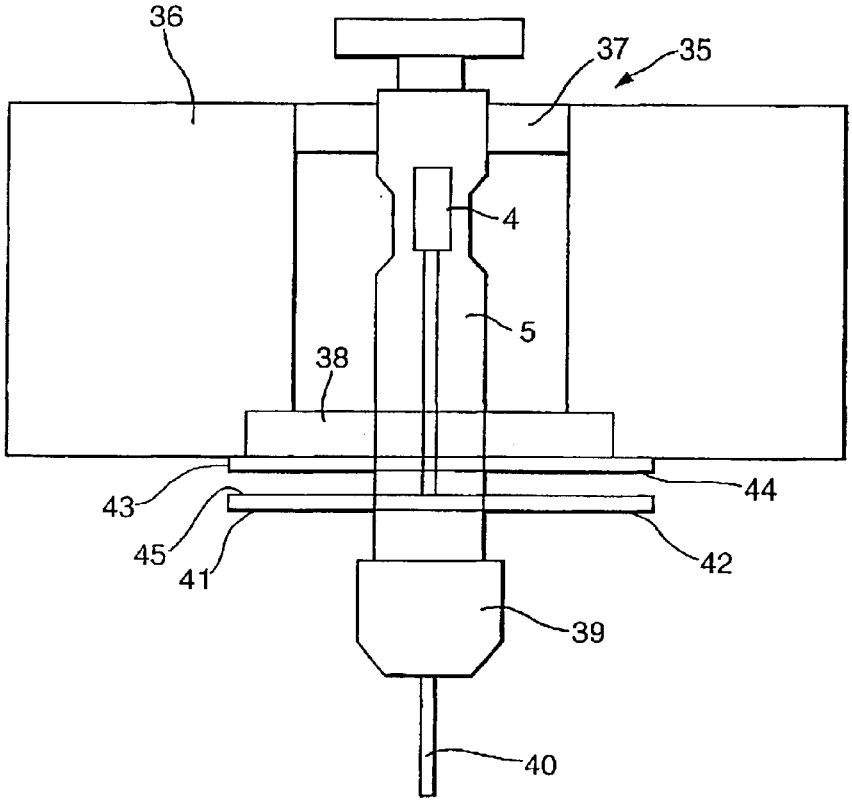
FIG. 10 illustrates schematically either of the first or second embodiments of the present invention in use in a multi-spindle drilling machine.

An application where the first and second embodiments 20,24 are preferred is shown in FIG. 10. This figure shows a multi-spindle drilling machine 35 comprising a metal body 36 in which a shaft 5 is rotatably supported on bearings 37,38. The shaft 5 is provided at one end with a chuck 39 and bit 40. At the end of the shaft 5 distal to the bit 30, the shaft is provided with a drive gear.

The shaft 6 has mounted thereon SAW devices 4. Each SAW device is electrically connected to a loop provided on a disc 41 secured to the shaft 5. The loops are on the face 42 of the disc 41 which is remote from a disc 43 secured to the body of the drilling machine. Loops connected to appropriate drive/measuring circuitry are provided on the face 44 of the disc 43 which is nearest to the disc 41. An electrical shield is provided on the face 45 of the disc 41 which is nearest the disc 43.

Several sets of loops may be provided if several SAW devices are required. The face of the disc 43 which is nearest the bearing 38 is provided with a grounded metal covering to act as a ground plane for the loops formed on the face 44. Accordingly, the loops connected to the drive/measuring circuit may form a transmission line.

Figure 11:
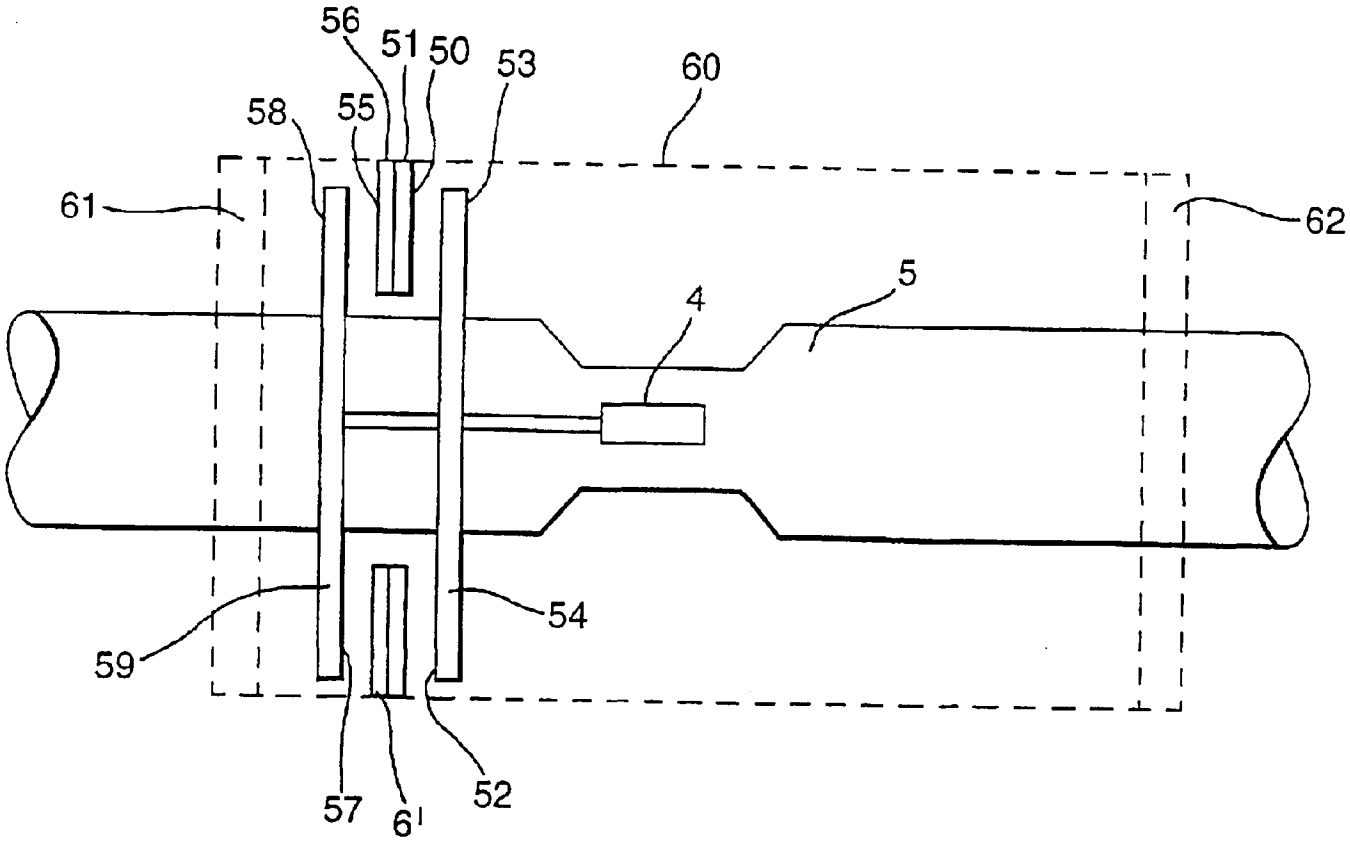
FIG. 11 illustrates schematically a fourth embodiment of the present invention.

Referring now to FIG. 11, a further embodiment of the invention is shown. In this embodiment a first loop 50 is provided on a first disc 51 while a first radial electric shield 52 and a second loop 53 are provided on a second disc 54 as described in relation to the first and second embodiments. A third loop 55 is provided on a third disc 50 while a second radial electric shield 57 and a fourth loop 58 are provided on a fourth disc 59 in an arrangement which is a mirror image of that described in relation to the first and second embodiments. The first and third discs 51,56 are fixedly secured to a support structure 60 and the second and fourth discs 54,59 are fixedly secured to the shaft 5 which is itself rotatably mounted to the support structure 60 by means of two bearings 61,62. Thus, by axially spacing the loops (rather than arranging them concentrically), the overall diameter of the coupler shown in FIG. 11 is less than that of the previously described couplers.

What is claimed is:

1. A rotary signal coupling device for providing signal coupling to a surface acoustic wave (SAW) device which is mounted on a shaft which is rotatable relative to a fixed structure, the coupler comprising:

a first electrically conductive loop, connected to the SAW device, and fixed relative to the shaft; a second electrically conductive loop, connectable to an electronic circuit, and fixed relative to the fixed structure, the first and second loops being arranged in juxtaposition to provide inductive coupling therebetween and being positioned to remain at a substantially constant mutual spacing as the shaft rotates relative to the fixed structure; and electrically conductive screen means disposed between the first loop and the second loop, the electrically conductive screen means being grounded.

2. A rotary signal coupling device according to claim 1 wherein each of said first and second electrically conductive loops are provided on an associated disc of material, one of the discs being fast with the shaft and the other of the discs being fast with the fixed structure relative to which the shaft is rotatable.

3. A rotary signal coupling device according to claim 2 wherein the electrically conductive screen means is provided on one of the discs.

4. A rotary signal coupling device according to claim 3 wherein the electrically conductive screen means comprises a screen provided on the surface of one of the discs.

5. A rotary signal coupling device according to claim 2 wherein the discs are arranged face to face with a small air gap or a wafer of insulating material therebetween.

6. A rotary signal coupling device according to claim 2 wherein one of said first and second electically conductive loops is provided on that face of its associated disc which is adjacent to the disc on which the other of said first and second electrically conductive loops is provided while the other of the first and second electrically conductive loops is provided on the face of its associated disc which is remote from the disc on which the one of said loops is provided.

7. A rotary signal coupling device according to claim 6 wherein the electrically conductive screen means is provided on that face of the other disc which is adjacent to the one disc.

8. A rotary signal coupling device according to claim 1 wherein the electrically conductive screen means comprises a metal screen.

9. A rotary signal coupling device according to claim 8, wherein the metal screen is formed by a plurality of radially extending fingers all of which are grounded.

10. A rotary signal coupling device according to claim 1 wherein one of the loops is electrically connected to the electrically conductive screen means.

11. A rotary signal coupling device according to claim 10 wherein the electrically conductive screen means forms a ground plane for said one of the first and second loops connected to the electrically conductive screen means, said one loop and the ground plane together forming a transmission line.

12. A rotary signal coupling device according to claim 1 including a plurality of first electrically conductive loops, of which said first electrically conductive loop is one, connected to a plurality of SAW devices, of which said aforementioned SAW device is one, each of said SAW devices fixed relative to the shaft; and a plurality of second electrically conductive loops, of which said aforementioned second electrically conductive loop is one, connectable to an associated electronic circuit which includes said electronic circuit, whereby signals may be transmitted between each of the SAW devices and the associated electronic circuit.

* * * * *